US011840831B2

(12) United States Patent
Song et al.

(10) Patent No.: US 11,840,831 B2
(45) Date of Patent: Dec. 12, 2023

(54) HIDDEN-DRAIN SINK

(71) Applicant: AS America, Inc., Piscataway, NJ (US)

(72) Inventors: Ki Bok Song, Plainview, NY (US); Alison Lyons, Jersey City, NJ (US); Jiekun Qian, Astoria, NY (US); Jean-Jacques L'Henaff, New Canaan, CT (US); Emilie Williams, New York, NY (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 16/770,123

(22) PCT Filed: Dec. 5, 2018

(86) PCT No.: PCT/US2018/063975

§ 371 (c)(1),
(2) Date: Jun. 5, 2020

(87) PCT Pub. No.: WO2019/113151

PCT Pub. Date: Jun. 13, 2019

(65) Prior Publication Data

US 2020/0385969 A1 Dec. 10, 2020

Related U.S. Application Data

(60) Provisional application No. 62/595,890, filed on Dec. 7, 2017.

(51) Int. Cl.
*E03C 1/186* (2019.01)

(52) U.S. Cl.
CPC ..... *E03C 1/186* (2013.01)

(58) Field of Classification Search
CPC ..... E03C 1/181; E03C 1/182; E03C 1/186; E03C 1/23; E03C 1/22; E03C 1/232; E03F 5/0407; E03F 5/0408
See application file for complete search history.

(56) References Cited

U.S. PATENT DOCUMENTS 863,825 A * 8/1907 Acker ..... E03C 1/18 4/642
3,566,418 A * 3/1971 Carlson ..... E03D 11/10 4/441

(Continued)

FOREIGN PATENT DOCUMENTS

DE 102008044637 A1 * 10/2009 ..... A47K 1/04
DE 202012103906 U1 11/2012

(Continued)

OTHER PUBLICATIONS

Machine Translation of DE202014004016. Espacenet. (Year: 2021).*
International Search Report dated Feb. 21, 2019 in corresponding International Application No. PCT/US2018/063975 (3 pages).

*Primary Examiner* — Erin Deery
(74) *Attorney, Agent, or Firm* — Tyler A. Stevenson; Anna-lisa L. Gallo

(57) ABSTRACT

A sink that includes a door that is positioned to visually obscure the drain, wherein the door can be opened by the user to access the drain when needed. The door includes a door adjustment mechanism that can allow for the door to be opened by a user and then held open without requiring user intervention. The door adjustment mechanism can also be configured to release the door and allow it to close through the actions of the user. In one or more examples, the door can be positioned so that a gap exists between an edge of the door and a basin portion of the sink. The gap can be large enough to allow for water to flow from the basin of the sink to the drain, but small enough to allow for the drain to be visually obscured.

13 Claims, 6 Drawing Sheets

(56) References Cited

U.S. PATENT DOCUMENTS

| | | | | | |
|---|---|---|---|---|---|
| 4,777,676 | A * | 10/1988 | Ericson | E03C 1/232 | 4/651 |
| 8,172,297 | B2 * | 5/2012 | Rhee | B60R 7/06 | 296/70 |
| 2007/0044228 | A1 | 3/2007 | Fulks | | |
| 2014/0366263 | A1 * | 12/2014 | Thompson | A47L 19/04 | 4/656 |

FOREIGN PATENT DOCUMENTS

| | | | | |
|---|---|---|---|---|
| DE | 202014004016 U1 | 8/2014 | | |
| JP | 2017110427 A * | 6/2017 | | E03C 1/186 |

* cited by examiner

HIDDEN-DRAIN SINK

This relates generally to sinks, and, in an embodiment, to a sink that includes a concealed drain that can be concealed by a door that allows access to the drain.

BACKGROUND

A drain can be employed in a sink to quickly evacuate water from the floor of the sink. While drains can allow for water to be evacuated from the sink quickly, they can be aesthetically unappealing.

Efforts to obscure the trench drain can create new issues in the design of a sink. As an example, in some instances, a user of the sink may need access to the trench drain to allow larger objects to drain or be disposed of in a garbage disposal attached to the drain. However, if the drain is visually obscured (for instance by a cover), larger items may not have access to the drain portion of the trench drain.

SUMMARY OF THE INVENTION

As explained above, covers that allow for water to flow into the drain while visually obscuring the drain can allow for the sink to maintain a desired visual aesthetic. As also explained above, the cover can provide a small slit or opening between the cover and the sink to allow water to flow into the trench drain. In this way, the trench drain can be visually obscured while at the same time maintaining a path for water to flow from the basin of the sink into the trench drain. However, employing a cover to a trench drain can be problematic in instances of use in which objects that are larger than the provided opening or slit require access to the trench drain. As an example, if the user of the sink wishes to clean the trench drain, or if the user wants to put solid objects such as food waste within the drain (i.e., when the drain is connected to a garbage disposal), a small slit or opening would be insufficient to allow for the desired access.

Accordingly, there is a need to not only cover or obscure the trench drain but to also provide a cover that is adjustable so as to provide access to the trench drain for instances of use in which the slit or opening created by the cover are inadequate. Disclosed herein are various embodiments of sinks with "hidden" trench drains that address this need. As explained herein, a trench drain may be hidden or obscured by a cover that is configured to visually obscure the trench drain while simultaneously providing a small opening or slit between the door and a basin of the sink so as to allow water to flow through the opening and into the trench drain. In one or more examples, the cover can be configured to be opened or adjusted so as to increase the size of the opening thereby allowing for access to the trench drain for objects that may not fit in the opening/slit when the cover is closed.

In one or more examples, the cover may be removable by a user. In another example, the cover may be adjustable so that a user can place the cover in a first position when seeking access to the trench drain, and can put the cover in a second position when seeking to simply obscure the trench drain while allowing water to flow from the basin of the sink into the trench drain. The cover can be configured with one or more of a hinge, a torsion spring and a detent so as to enable the user to fix the cover into either a first position or a second position. In one example, the cover can be configured such that when a user pushes the cover a first time the position of the cover changes to provide wider access to the trench drain, and when the user pushes the cover a second time, the cover returns to its original position thereby obscuring the trench drain while providing an opening to allow water to flow into the trench drain from the sink basin.

These and other features, aspects, and advantages of the disclosure will be apparent from a reading of the following detailed description together with the accompanying drawings, which are briefly described below. The invention includes any combination of two, three, four, or more of the disclosed embodiments as well as combinations of any two, three, four, or more features or elements set forth in this disclosure, regardless of whether such features or elements are expressly combined in a specific embodiment description herein. This disclosure is intended to be read such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

In the following description of the disclosure and embodiments, reference is made to the accompanying drawings in which are shown, by way of illustration, specific embodiments that can be practiced. It is to be understood that other embodiments and examples can be practiced, and changes can be made without departing from the scope of the disclosure.

In addition, it is also to be understood that the singular forms "a," "an," and "the" used in the following description are intended to include the plural forms as well, unless the context clearly indicates otherwise. It is also to be understood that the term "and/or" as used herein refers to and encompasses any and all possible combinations of one or more of the associated listed items. It is further to be understood that the terms "includes," "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Figure 1A:
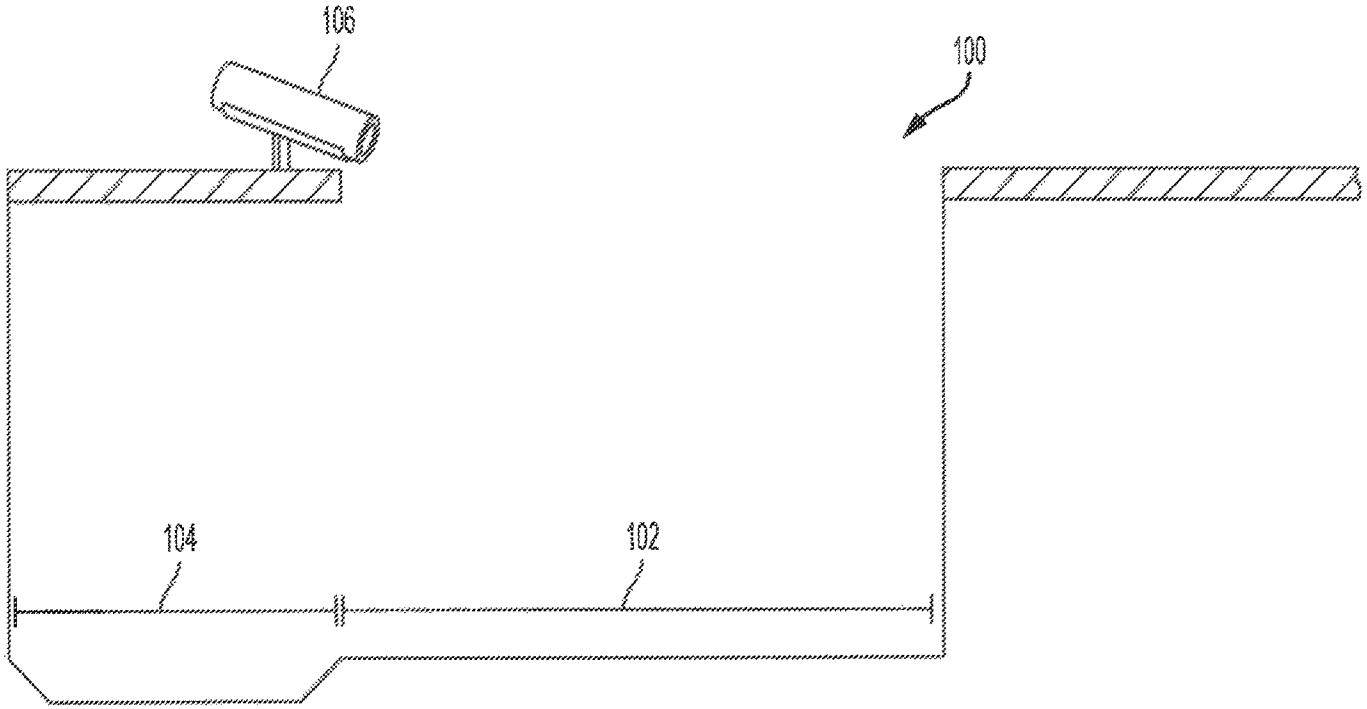
FIG. 1A illustrates an example of a sink configured with a trench drain according to an embodiment of the disclosure.

FIG. 1A illustrates an example of a sink configured with a trench drain according to some embodiments of the disclosure. As illustrated in FIG. 1A, a sink 100 can include a basin portion 102, a trench drain 104, and a faucet 106. The basin portion 102 can initially receive water that flows from faucet 106 when the faucet is turned on. The trench drain 104 can adjoin the basin portion 102 (in some examples they could be made from one piece of material or can be put together as two separate pieces) and may be set lower than the basin portion. In other words the bottom of the trench drain 104 can be lower than the basin portion 102 such that gravity will move water initially received by the basin portion to the trench drain 104. By setting the trench drain 104 such that it is lower with respect to the basin portion 102, water can move more rapidly towards the trench drain due to the force of gravity in contrast to an example where the trench drain is set level to the basin portion 102. In one or more embodiments of the disclosure, the basin portion 102 can be a level surface. In alternate embodiments, the basin portion 102 can be angled towards the trench drain 104 so as to provide a downhill path for water to flow from the basin portion 102 to the trench drain 104. In another embodiment, the trench drain 104 can be sloped towards drain 110 such that a downhill path is between the basin portion 102 and the trench drain 104.

While the specification discusses the use of a trench drain, the disclosure should not be seen as being limited to sinks that have trench drains. The door can be used to obscure any type of sink drain known to those in the art. In one or more examples the sink can have a conventional drain, and the drain can be positioned at the same level as the basin portion.

Figure 1B:
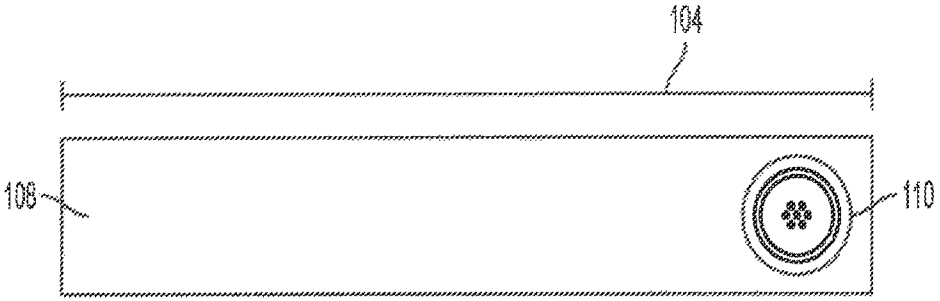
FIG. 1B illustrates an example of a top view of the trench drain of the sink illustrated in FIG. 1A according to an embodiment of the disclosure.

FIG. 1B illustrates an example of a top view of the trench drain of the sink illustrated in FIG. 1A according to examples of the disclosure. As illustrated in FIG. 1B, the trench drain 104 can include a trench portion 108 and a drain portion 110. The trench portion 108 can receive water that flows from the basin portion 102 of the sink 100. The drain portion 110 can include a hole or holes through which water flows into a connecting pipe (not pictured) that connects the drain of the sink to a plumbing system.

As discussed above, a trench drain as illustrated in FIG. 1A and FIG. 1B can allow for water to rapidly flow from the basin to the drain due to the force of gravity forcing the water from a higher position in the basin to the lower position of the trench drain. However, from an aesthetic perspective, a trench drain may be undesirable or less aesthetically pleasing than a conventional drain system found in sinks. Thus, it may be desirable to obstruct the user's view of the trench drain while simultaneously maintaining the benefits derived from a trench drain (i.e., rapid draining of water).

In one or more embodiments, in order to visually obscure the trench drain from sight, a door can be employed that obscures the trench drain while simultaneously maintaining a path for water to flow from the basin portion of the sink into the trench drain. In this way, the trench drain can be visually obscured while at the same time allowing for the benefits of the trench train (i.e., rapid water draining) to be realized.

Figure 2A:
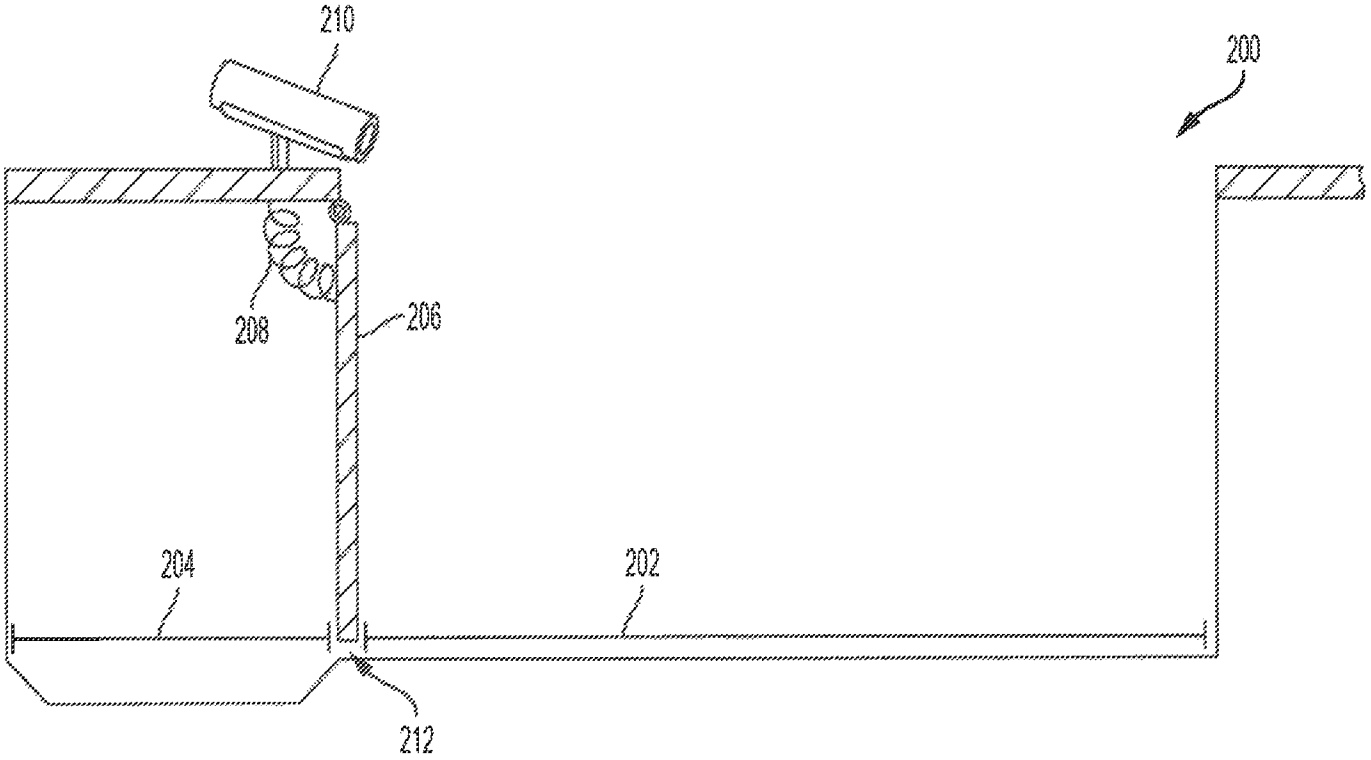
FIG. 2A illustrates an example of a sink configured with a trench drain and a cover for the trench drain according to an embodiment of the disclosure.

FIG. 2A illustrates an example of a sink configured with a trench drain and a cover for the trench drain according to some embodiments of the disclosure. As illustrated in the embodiment of FIG. 2A, the sink 200 (similar to the sink discussed with respect to FIG. 1A and FIG. 1B) can include a basin portion 202, a faucet 210, and a trench drain 204. Basin portion 202, faucet 210, and trench drain 204 can be identical to their counterparts 102, 106, and 104 discussed above with respect to FIG. 1A and FIG. 1B. Furthermore, trench drain 204 can include a trench portion and a drain portion like the example discussed above with respect to FIG. 1B.

Figure 2B:
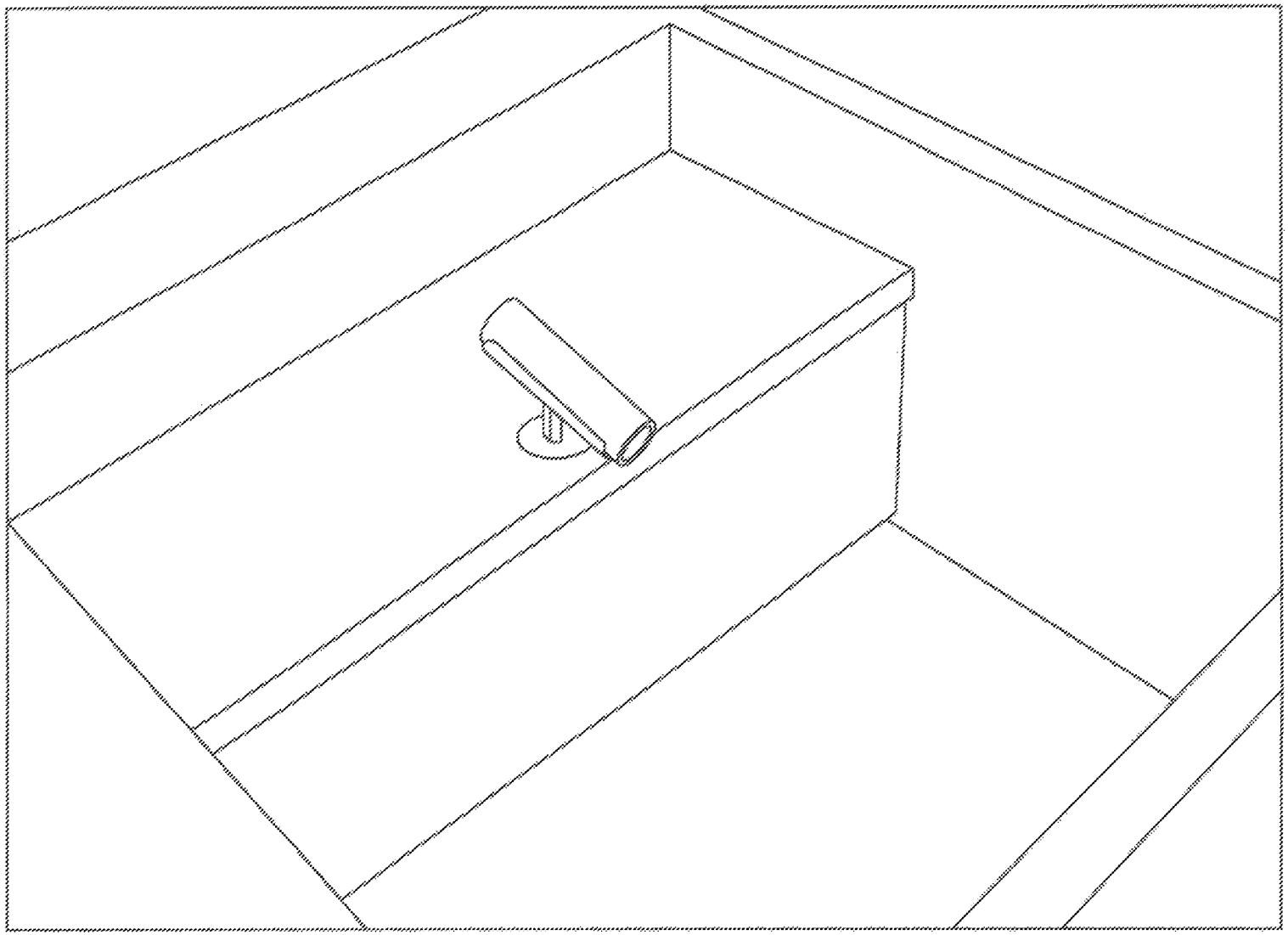
FIG. 2B illustrates another view of the sink illustrated in FIG. 2A according to an embodiment of the disclosure.

Sink 200 of FIG. 2A can also include a door 206 that can act to visually obscure the trench drain 204 from a user. The door 206 can be positioned such that a gap 212 is created between the bottom of the door and the basin portion 202 of sink 200. In one or more examples, the gap 212 created between basin portion 202 and the bottom of the door 206 can be small enough so as to visually obscure the trench drain 204 from a user's vision. In other words, a user of the sink cannot see the trench drain 204 when the door 206 is closed. FIG. 2B provides an alternate view of the sink 200 that illustrates how the door 206 can act to conceal the trench drain 204.

In one or more embodiments of the disclosure, the gap 212 created between the door 206 and the basin portion 202 can be large enough to allow water received by the basin portion to flow through the gap 212 into the trench drain 204. In an embodiment, the gap 212 can be large enough to allow water to flow through it freely without any surface tension of the water causing a blockage in flow. In other words, the gap 212 between the door 206 and the trench drain 204 can be large enough such that the surface tension of the liquid flowing through does not get "stuck" in the gap thereby reducing the rate of flow of the liquid from the basin portion 202 to the trench drain 204. If the gap 212 between the door 206 and the trench drain 204 is too small, the surface tension of the liquid flowing through the gap may cause the water to become trapped against the surface of the door and the trench drain thereby reducing the flow of the water thereby potentially obviating the benefits realized through the use of trench drain. FIG. 2B illustrates the door 206, and the gap 212 from an alternative angle.

While the door 206 can allow for the trench drain 204 to be obscured from sight, in some use instances, the door may act as an impediment to functionality. As an example, if a user wanted to place food waste in the trench drain 204, or some other object that may not fit through the gap 212, then the door 206 could impede the functionality of the sink 200. In another example, the presence of door 206 could make cleaning of the trench drain difficult because a human hand or a cleaning tool may not be able to be inserted through the gap 212 so as to get access to the trench drain 204 for cleaning.

One way the above problem can be overcome is to allow door 206 to be adjustable so that the gap 212 created between door 206 and basin portion 212 can be enlarged or decreased based on the user's desire. In one or more embodiments, a door 206 of sink 208 can include a door adjustment mechanism 208. Door adjustment mechanism 208 can be configured to enable the door 206 to move such that the door can be opened and closed. By enabling the door 206 to open and close using the door adjustment mechanism 208, the user can gain access to the trench drain 204 when they desire.

In one or more embodiments, the door adjustment mechanism can include a resilient member and a detent. The resilient member can be configured to resist a user's force when the user is opening the door 206 and then can "spring back" to its original form when the user ceases to apply a force to the door causing the door to close again. In this way, the door 206 can be opened by the user to access the trench drain 204. In one or more embodiments of the disclosure, the resilient member can include a compression spring, a tension spring, or a torsion spring. Alternatively, rather than employing a spring, the resilient member of the door adjustment mechanism can include any material that can deform and absorb energy in the presence of a force and revert back to its original form once the force is removed.

In one or more embodiments of the disclosure, the user may wish to hold the door 206 in the open position after pushing it open. In this way, the user would not be required to apply a constant force to the door 206 to keep it ajar and can rather push the door to the open position and have the door be held there until the user is ready for the door to be closed. Thus, in one or more embodiments, a door adjustment mechanism, in addition to a resilient member as described above can also include a detent. A detent can refer to any device that is used to mechanically resist or arrest motion of an object until the detent is released. In the example of door adjustment mechanism 208, a detent can act to mechanically resist and arrest the motion of the resilient member that is trying to spring back thereby closing the door. Instead, the detent can resist the motion of the resilient member thereby keeping the door open without requiring the user to hold the door open.

In one or more embodiments, the user can close the door by pushing on the door so as to release the detent which then can allow the resilient member to return the door back to its closed position. In this way, the user can control the position of the door and keep it either open or closed based on their desired use. While the door adjustment mechanism 208 is described above as comprising a resilient member and a detent, the disclosure should not be seen as limited to that embodiment. A person of skill in the art will appreciate that a door adjustment mechanism 208 that allows for a user to open the door 206 and keep the door open, and then close the user door when the user desires as described above can be implemented in numerous ways.

The door 206 and the basin portion 202 can be made from the same materials. In one example both the door 206 and the basin portion 202 can be made from stainless steel. In another example, both the door 206 and the basin portion 202 can be made from a polymer or ceramic.

Figure 3A:
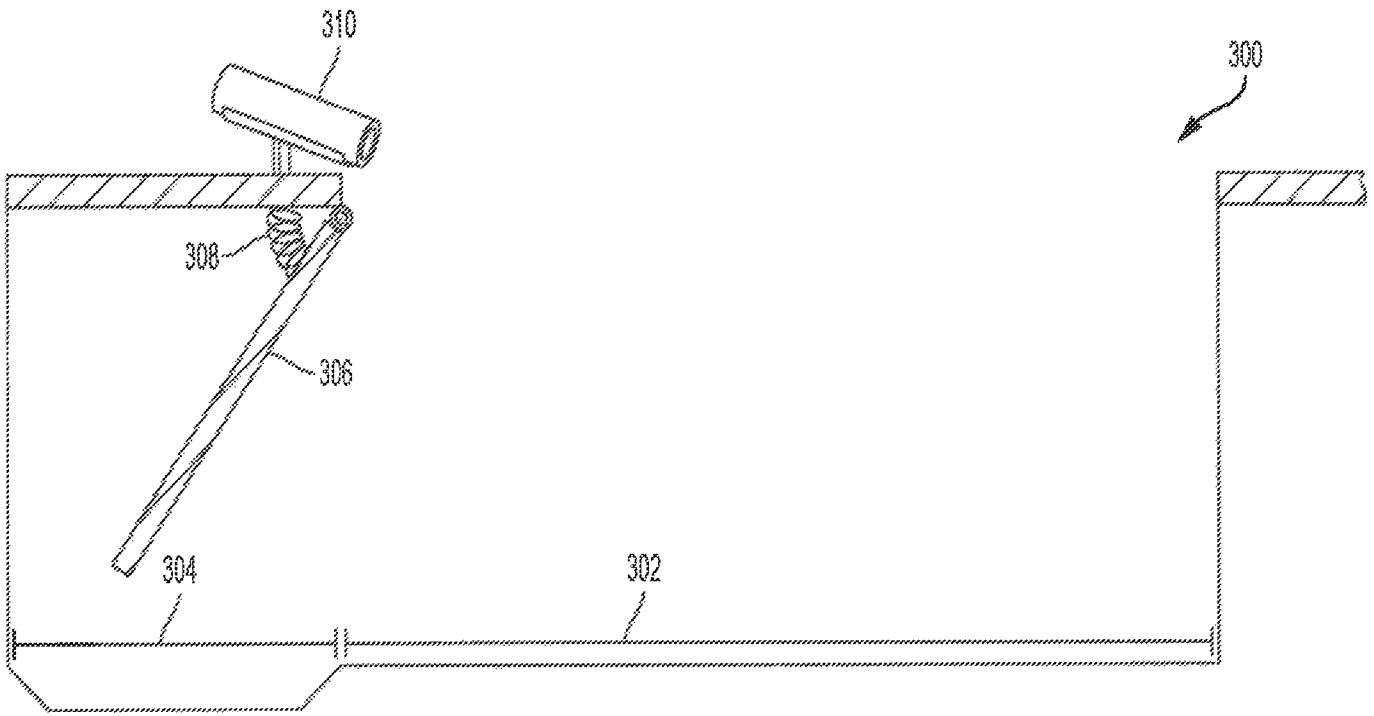
FIG. 3A illustrates an example of a sink configured with a trench drain and an adjustable cover for the trench drain in an open position according to an embodiment of the disclosure.

FIG. 3A illustrates an example of a sink configured with a trench drain and an adjustable cover for the trench drain in an open position according to embodiments of the disclosure. The example of FIG. 3A illustrates a sink that is identical to the sink illustrated in FIG. 2A and FIG. 2B, but illustrates the door 306 in an open position. Therefore sink 300, basin portion 302, trench drain 304, door 306, door adjustment mechanism 308, and faucet 310 are identical or similar to their counterparts found in FIG. 2A and FIG. 2B. A detailed discussion of those components can be found above. As illustrated in FIG. 3A, when door 306 is open, a user can have access to trench drain 304 for cleaning or other various uses described above. Also as discussed above with respect to FIG. 2A and FIG. 2B, the door adjustment mechanism 308 can be configured to allow for the user of the sink to keep the door in the open position without requiring the user's intervention. In other words, once the user pushes the door 306 open, the door can stay open (due to the door adjustment mechanism 308) until the user pushes the door again to close it. In one example, the user can push the door 306 thereby causing the detent that is part of the door adjustment mechanism 308 to release. When the detent releases, the resilient member of the door adjustment mechanism 308 can spring back to its original form thereby closing the door.

Figure 3B:
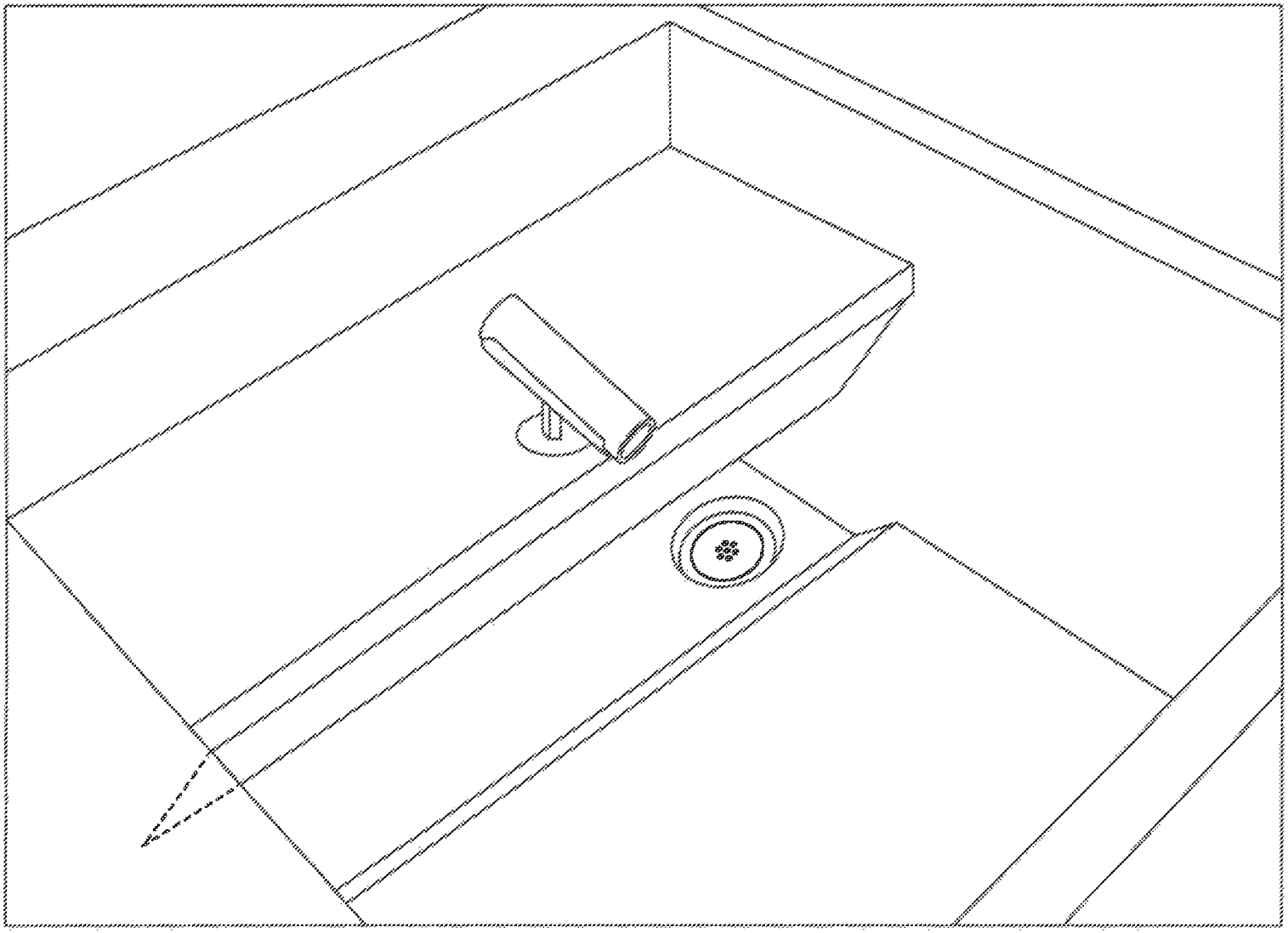
FIG. 3B illustrates another view of the sink illustrated in FIG. 3A according to an embodiment of the disclosure.

FIG. 3B illustrates another view of the sink illustrated in FIG. 3A according to examples of the disclosure. The view of FIG. 3B further illustrates the accessibility of the trench drain 304 when the door 306 is open.

Figure 4A:
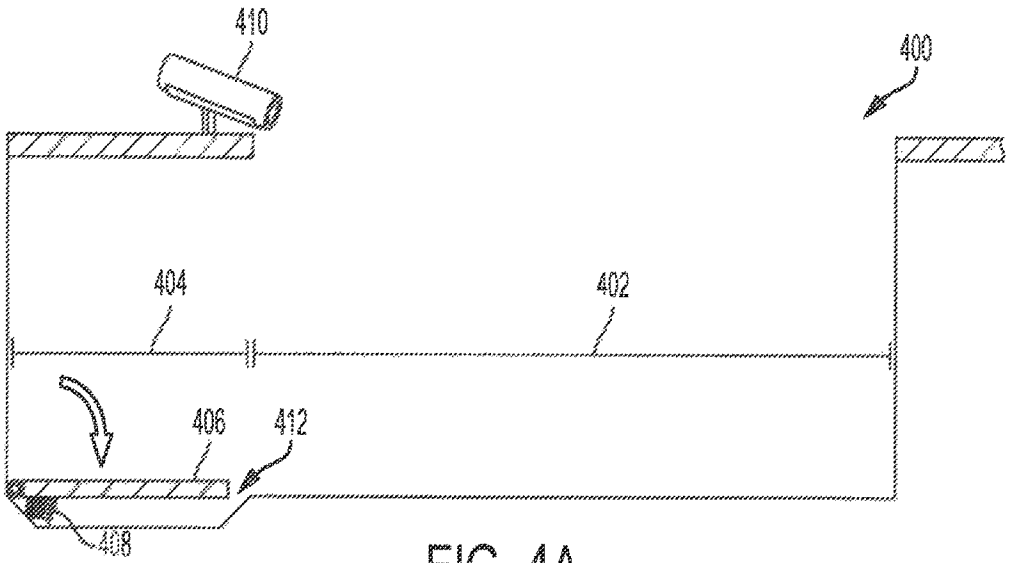
FIG. 4A and FIG. 4B illustrate an example of a sink configured with a trench drain and an adjustable cover for the trench drain according to an embodiment of the disclosure.
Figure 4B:
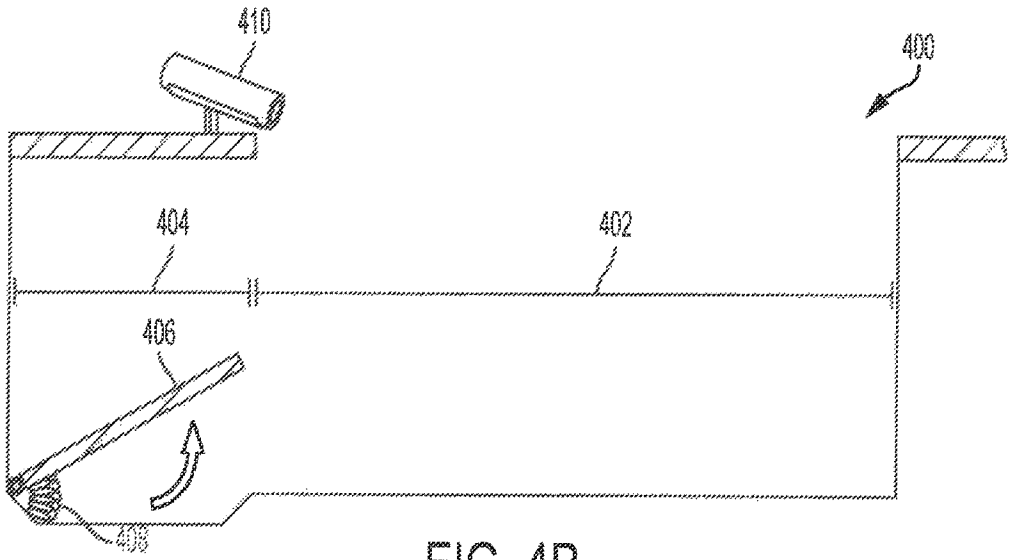

In the embodiments described above with respect to FIG. 2A through FIG. 3B, the door 206 of FIG. 2A and FIG. 2B and the door 306 of FIG. 3A and FIG. 3B are illustrated as being oriented perpendicular to their respective basin portions. However, the disclosure should not be seen as limited to doors in that configuration. In one or more examples, the door can be oriented parallel to the drain basin. FIG. 4A and FIG. 4B illustrate an exemplary sink with a trench drain and a door that is oriented in parallel with the basin according to embodiments of the disclosure. The example of FIG. 4A illustrates a sink that is nearly identical to the sink illustrated in FIG. 2A and FIG. 2B, but illustrates a door 406 oriented parallel to the basin portion 402 of sink 400. Therefore sink 400, basin portion 402, trench drain 404, door adjustment mechanism 308, and faucet 310 are substantially identical or similar to their counterparts found in FIG. 2A and FIG. 2B. A detailed discussion of those components can be found above. As discussed above, the door 406 in the example of FIG. 4A can be oriented parallel to the basin portion 402. The door 406, when closed, can act to visually obscure the trench drain 404. The door 406 can be positioned such that a gap 412 is created between an edge of the door and the basin portion 402. The properties of gap 412 can be similar to the properties of the gap 212 of FIG. 2A and FIG. 2B, and gap 312 of FIG. 3A and FIG. 3B, insofar as the gap can be large enough to let water pass unimpeded while simultaneous small enough so as to visually obscure the trench drain 404 for sight.

Similar to the embodiments of FIG. 2A and FIG. 3A, the door 406 can include a door adjustment mechanism 408 that can allow the door to be opened by a user and held open without requiring continuous intervention from the user. Door adjustment mechanism 408 can also be configured to be closed by the user when the user so desires. FIG. 4B illustrates the door of FIG. 4A in an open position.

In one or more examples, the door 406 may not include a door adjustment mechanism 408. Instead, the door 406 may act as a cover for the drain 404, wherein the cover can be elevated from the drain with projection to allow water to flow beneath the projection.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

This application discloses several numerical ranges in the text and figures. The numerical ranges disclosed inherently support any range or value within the disclosed numerical ranges, including the endpoints, even though a precise range limitation is not stated verbatim in the specification because this disclosure can be practiced throughout the disclosed numerical ranges.

Following are some embodiments of the invention.

In a first embodiment, disclosed is a sink comprising: a basin portion for receiving water dispensed by the faucet; a drain for receiving water from the basin portion; and a door to visually obscure the drain in a closed position wherein the door is positioned relative to the basin such that a gap is formed between an edge of the door and the basin when the door is in the closed position so as to allow water from the basin into the drain, and wherein the door can be opened to allow a user to access the drain.

In a second embodiment, disclosed is a sink of the first embodiment, wherein the drain is a trench drain, in some embodiments a position of the trench drain relative to the basin portion is such that gravity causes water to flow from the basin into the trench drain.

In a third embodiment, disclosed is a sink according to any of the preceding embodiments, wherein a size of the gap between the edge of the door and the basin is large enough to allow for water from the basin to flow into the drain unimpeded. In a fourth embodiment, disclosed is a sink according to any of the preceding embodiments, wherein the door includes a door adjustment mechanism that is configured to keep the door open without the user's intervention once the door is opened. In a fifth embodiment, disclosed is a sink according to any of the preceding embodiments, wherein the door adjustment mechanism includes a resilient member configured to resist a user's force when the user is opening the door.

In a sixth embodiment, disclosed is a sink according to any of the preceding embodiments, wherein the resilient member is a spring; in some embodiments a compression spring. In a seventh embodiment, disclosed is a sink according to any of the preceding embodiments, wherein the door adjustment mechanism includes a detent, and wherein the detent and the resilient member are configured to keep the door open without the user's intervention once the door is opened.

In an eighth embodiment, disclosed is a sink of any of the preceding embodiments, wherein the door is perpendicular to the basin. In a ninth embodiment, disclosed is a sink of any of the preceding embodiments, wherein the door is parallel to the basin, for example when the drain is a trench drain.

In a tenth embodiment, disclosed is a sink according to any of the preceding embodiments, wherein the basin portion and the door are made from a same material. In some embodiments, a material comprises stainless steel, in other embodiments, a material comprises a polymer, for example a synthetic polymer.

In an eleventh embodiment, disclosed is a sink according to any of the preceding embodiments, wherein the drain is configured to be connected to a garbage disposal system. In a twelfth embodiment, disclosed is a sink according to any of the preceding embodiments, wherein the door is configured to be opened during use of the sink to allow food waste that is too large to fit in the gap to be disposed of in a garbage disposal.

In a thirteenth embodiment, disclosed is a sink according to any of the preceding embodiments, wherein the door is configured to be opened for cleaning of the drain.

The invention claimed is:

1. A sink comprising a basin portion having a level basin surface for receiving water;

a trench portion having a trench surface and a drain; and a door having a surface configured to visually obscure the trench portion, wherein, the basin surface and the trench surface comprise a length and a width, the basin surface length being substantially the same as the trench surface length, and the basin surface width being greater than the trench surface width, the trench surface is configured to receive water from the basin surface, the drain is positioned along the trench surface length and comprises one or more holes configured for water to flow through to a connecting pipe, the basin level surface and the trench surface are joined by an angled surface, when the door is in a closed position, the trench portion is visually obscured and a gap is formed between an edge of the door and the basin surface thereby allowing water to flow from the basin surface to the trench surface, the door is configured to be placed in an open position to allow access to the trench portion, the door includes a door adjustment mechanism comprising a resilient member and a detent, the door adjustment mechanism is configured to resist a user's force when the user pushes the door surface a first time to place it in the open position, to hold the door in the open position, and to return the door to the closed position when the user pushes the door surface a second time, the trench surface is set at a lower position than the basin level surface, and the lower position of the trench surface relative to the basin level surface is such that gravity causes water to flow from the basin surface to the trench surface.

2. The sink of claim 1, wherein the basin portion and the door comprise a same material.

3. The sink of claim 2, wherein the basin portion or the door comprise stainless steel or a polymer.

4. The sink of claim 1, wherein the trench surface is level.

5. The sink of claim 1, wherein the trench surface is sloped towards the drain.

6. The sink of claim 1, wherein when the door is in the open position, the trench portion is available to be cleaned.

7. The sink of claim 1, wherein, in the closed position, the door is perpendicular to the basin level surface.

8. The sink of claim 7, wherein, the door is configured to open towards the drain.

9. The sink of claim 1, wherein, in the closed position, the door is parallel to the basin level surface.

10. The sink of claim 9, wherein, the door is configured to open away from the drain.

11. The sink of claim 1, wherein the resilient member is a spring.

12. The sink of claim 1, wherein the resilient member is a compression spring.

13. The sink of claim 1, wherein, the door is configured to open towards the drain.

* * * * *